United States Patent [19]

Lowe

[11] 4,270,506

[45] Jun. 2, 1981

[54] GENERATING VAPOR OF A VOLATILE NORMALLY LIQUID FUEL AND OPERATING AN INTERNAL COMBUSTION ENGINE THEREWITH

[75] Inventor: Charles L. Lowe, Laurel, Miss.

[73] Assignee: Jacob H. Grayson, Hattiesburg, Miss. ; a part interest

[21] Appl. No.: 35,264

[22] Filed: May 1, 1979

[51] Int. Cl.[3] ..... F02M 17/16

[52] U.S. Cl. ..... 123/523; 261/91

[58] Field of Search ..... 123/133, 134, 34 A, 123/523; 261/91, DIG. 19

[56] References Cited

U.S. PATENT DOCUMENTS

| | | | |
|---|---|---|---|
| 860,522 | 7/1907 | Brown | 123/134 |
| 1,622,413 | 3/1927 | Brockway | 261/91 |
| 1,829,663 | 10/1931 | Mast | 123/133 |
| 1,970,166 | 8/1934 | Cloud | 123/133 |
| 1,980,496 | 11/1934 | Musselwhite | 123/133 |
| 2,105,992 | 1/1938 | Tolman | 261/91 |
| 3,278,174 | 10/1966 | Wahnish | 261/91 |
| 3,306,273 | 2/1967 | Dolphin | 123/133 |
| 3,713,429 | 1/1973 | Dwyre | 123/134 |
| 3,728,092 | 4/1973 | Gorman . | |
| 3,800,533 | 4/1974 | Zankowski | 123/134 |
| 3,931,801 | 1/1976 | Rose | 123/133 |
| 4,031,874 | 6/1977 | Alwine | 123/134 |

FOREIGN PATENT DOCUMENTS

| | | | |
|---|---|---|---|
| 112218 | 1/1918 | United Kingdom | 261/91 |

*Primary Examiner*—Ronald H. Lazarus

*Attorney, Agent, or Firm*—L. S. Van Landingham, Jr.

[57] ABSTRACT

A modified internal combustion engine useful as a power plant in automotive vehicles is operated on an admixture of air and fuel vapor. An apparatus is disclosed for generating the fuel vapor from a volatile normally liquid fuel of the type useful in operating a conventional internal combustion engine having a prior art carburetor. Apparatus is also disclosed for safely handling and controlling the fuel vapor thus generated, and utilizing the same in the operation of the internal combustion engine. In a further aspect, a novel method is provided for generating vapor of a volatile liquid fuel and operating an internal combustion engine therewith. The method is also useful in modifying a conventional internal combustion engine including a prior art carburetor. The resultant modified internal combustion engine operates more efficiently and with lower exhaust emissions.

35 Claims, 13 Drawing Figures

GENERATING VAPOR OF A VOLATILE NORMALLY LIQUID FUEL AND OPERATING AN INTERNAL COMBUSTION ENGINE THEREWITH

THE BACKGROUND OF THE INVENTION

1. The Field Of The Invention

The present invention broadly relates to the operation of an internal combustion engine on an admixture of air and fuel vapor generated from a volatile normally liquid fuel. In one of its more specific aspects, the invention is concerned with improved apparatus for generating fuel vapor from a volatile normally liquid fuel for an internal combustion engine. In another of its aspects, the invention relates to improved apparatus for safely handling and controlling the fuel vapor thus generated, and utilizing the same in the operation of the internal combustion engine. The invention is additionally concerned with a novel method of generating vapor of a volatile liquid fuel and operating an internal combustion engine therewith. The method is also useful in modifying a conventional internal combustion engine including a prior art carburetor for preparing a fuel charge from a volatile normally liquid fuel, whereby the said internal combustion engine following modification is capable of operating more efficiently and with lower exhaust emissions.

2. The Prior Art

Conventional gasoline powered internal combustion engines include a carburetor into which the gasoline is introduced and atomized, and atmospheric air is introduced simultaneously and admixed with the atomized gasoline. The liquid gasoline is not completely vaporized at the time of combustion and a substantial amount exists in the form of finely divided droplets which do not burn completely. As a result, prior art internal combustion engines utilizing a conventional carburetor for preparation of an air-liquid fuel admixture to be combusted are very inefficient. They are also further characterized by unacceptable levels of undesirable exhaust emissions, such as carbon monoxide and uncombusted hydrocarbons.

It has been recognized heretofore that the efficiency of internal combustion engines of the aforementioned type could be improved and the exhaust emissions reduced by vaporizing the liquid fuel, and then admixing the resultant fuel vapor with atmospheric air to prepare the charge to be combusted. However, the prior art systems available for generating the fuel vapor and thereafter utilizing the same in the operation of an internal combustion engine have not been entirely satisfactory.

For instance, the prior art systems for generating fuel vapor often involve heating the liquid fuel with hot exhaust gases, or other sources of high temperature, to thereby evaporate the same at an elevated temperature which may approach or reach the boiling point. The resultant hot fuel vapor has a relatively low volumetric efficiency per unit of volume when admixed with atmospheric air in the preparation of the charge to be combusted. This reduces the amount of power developed by the internal combustion engine as compared with the theoretical amount of power available when using cool fuel vapors in preparing the charge. The use of elevated temperature in evaporating the liquid fuel also creates an unacceptable fire and/or explosion hazard which endangers the lives of occupants in an automotive vehicle powered by the internal combustion engine. Additionally, the hot fuel vapor is unstable and tends to form fog-like finely divided liquid fuel droplets. These fuel droplets remain suspended in the fuel vapor and fail to combust completely, and thus reduce efficiency and increase exhaust emissions. The instability of the hot fuel vapor also results in liquid fuel being deposited on surfaces in contact therewith. The surfaces wetted with the liquid fuel create a fire hazard, and inasmuch as the liquid fuel deposited thereon is not available for combustion, the overall efficiency is further reduced.

In other systems for generating fuel vapor proposed heretofore, atmospheric air is bubbled through the liquid fuel, and/or the atmospheric air is directed directly onto the liquid fuel surface. In some instances, these systems require means for heating the liquid fuel and/or the air to a sufficiently elevated temperature to assure evolution of sufficient fuel vapor for operating the internal combustion engine. Also, these systems introduce sufficient air to result in an explosive mixture being produced for operating the internal combustion engine. Thus, an unacceptable fire and explosion hazard is created.

In view of the foregoing, it is apparent that the prior art systems for generating fuel vapor, handling and/or controlling the resultant fuel vapor, and utilizing the same in the operation of an internal combustion engine have not been entirely satisfactory. The present invention overcomes the deficiencies of the prior art and provides an entirely satisfactory method and apparatus for generating vapor of a volatile liquid fuel and operating an internal combustion engine therewith.

THE SUMMARY OF THE INVENTION

The apparatus of the invention for generating vapor of a volatile liquid fuel and operating an internal combustion engine therewith includes vessel means containing the fuel vapor thus generated and an internal combustion engine. The internal combustion engine has a plurality of cylinders for combustion of the fuel vapor, and fuel vapor supply means for supplying a mixture of the fuel vapor and air to the cylinders for combustion in response to reduced pressure within the cylinders. The fuel vapor supply means includes an intake manifold and fuel vapor conduit means in communication with the interior of the intake manifold means whereby suction is applied thereto when the fuel vapor is supplied the cylinders upon operating the internal combustion engine. The fuel vapor conduit means has first and second end portions. The first end portion is in communication with the interior of the intake manifold, and the second end portion is in communication with an upper portion of the interior of the vessel means containing the fuel vapor. Thus, when the internal combustion engine is operating, the fuel vapor supply means supplies fuel vapor to the cylinders and suction is applied to the fuel vapor conduit means which causes fuel vapor to be withdrawn from an upper portion of the vessel means by suction and then passed through the fuel vapor conduit means to the intake manifold. Means is provided for vaporizing the volatile normally liquid fuel to thereby produce additional fuel vapor in the vessel means. The fuel vapor phase in the upper portion of the interior of the vessel means is free of fuel in the form of liquid finely subdivided particles when withdrawn via the fuel vapor conduit means. The method of the invention for generating fuel vapor may utilize the aforementioned apparatus for generating vapor.

The present invention is also useful in handling, controlling and utilizing the fuel vapor thus prepared. In practicing this further improvement of the invention, means is provided for admixing air with fuel vapor in the vessel means to thereby produce an admixture of air and fuel vapor which is withdrawn from the vessel means via the fuel vapor conduit means. The means for admixing air with the fuel vapor is effective to produce an admixture of air and fuel vapor withdrawn via the fuel vapor conduit means containing sufficient air to reduce the dew point of the fuel vapor, but insufficient air to produce an explosive mixture, and less than that amount of air required for efficient combustion. The fuel vapor conduit means includes means for adjusting the ratio of air to fuel vapor in the admixture thereof withdrawn from the vessel means prior to its reaching the intake manifold means to thereby add additional air and produce an admixture containing sufficient air for efficient combustion of the fuel vapor. The aforementioned apparatus may also include means located between the second end portion of the fuel conduit means and the means for adjusting the ratio of air to fuel vapor for protecting the vessel means against backfire from the internal combustion engine.

It will be appreciated that the aforementioned novel method and improved apparatus of the invention have certain preferred variants and embodiments. These preferred variants and embodiments will be discussed with greater particularity hereinafter, and thus they will be apparent upon considering the following detailed description of the invention. The present invention is intended to embrace these further preferred variants and embodiments, as well as those additional variants and embodiments which will be apparent to those skilled in this art upon considering the applicant's teachings in the light of the prior art.

A BRIEF DESCRIPTION OF THE ACCOMPANYING DRAWINGS

The invention will be described hereinafter in greater particularity with reference to the presently preferred embodiments thereof illustrated in the accompanying drawings, wherein:

FIG. 5 is a fragmentary cross-sectional view taken along the line *5a—5a* of FIG. 5;

Figure 9:
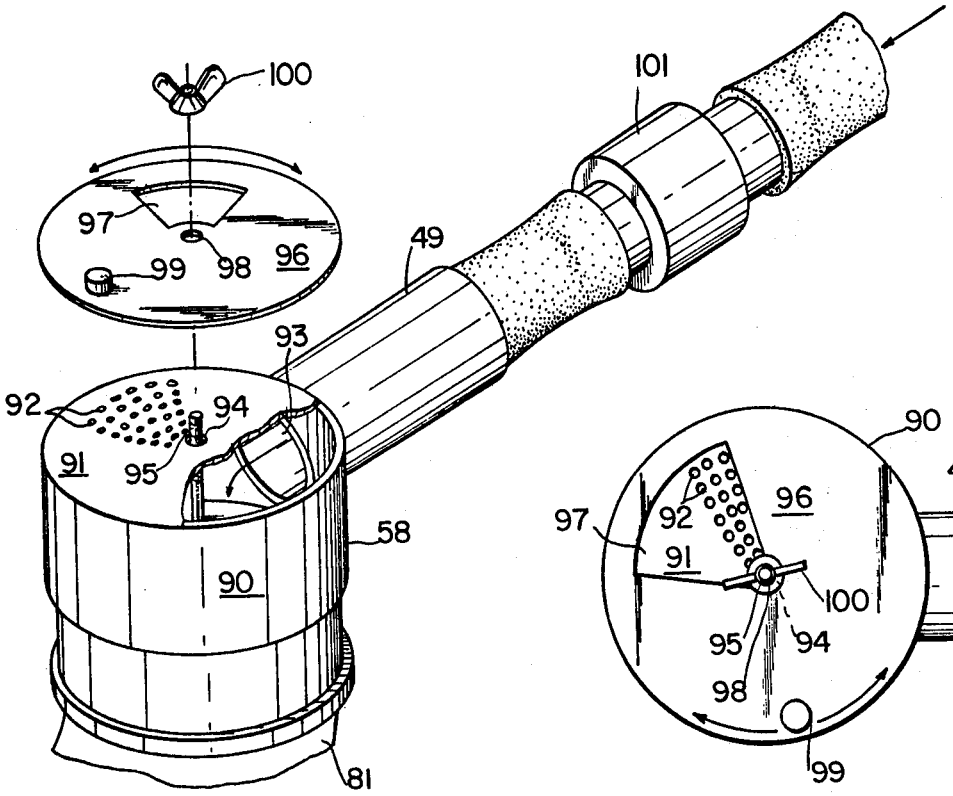
FIG. 9 is an exploded view, with a portion thereof being broken away to illustrate the interior, of one presently preferred embodiment of apparatus for controlling the amount of atmospheric air added to fuel vapor in preparing an admixture for combustion in an internal combustion engine operated in accordance with the present invention.
Figure 12:
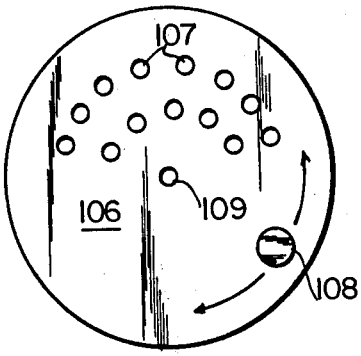
Figure 13:
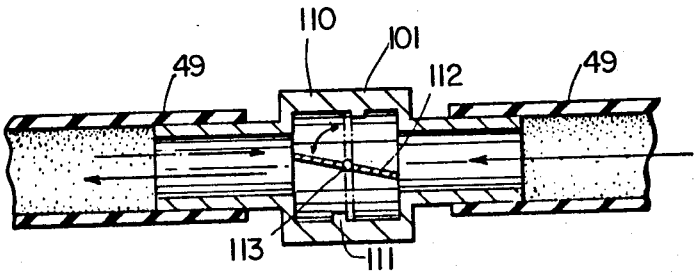

FIG. 12 is a top view of the air control disc for use with the apparatus of FIG. 9, further illustrating the arrangement of the air intake holes in the modified form of the apparatus of FIG. 9; and FIG. 13 is a longitudinal cross-sectional view in elevation, with portions thereof being broken away, of the section of the vapor suction conduit including the check valve of the invention for preventing damage to the fuel vapor generating tank by backfire from the internal combustion engine.

THE DETAILED DESCRIPTION OF THE INVENTION INCLUDING THE PRESENTLY PREFERRED VARIANTS AND EMBODIMENTS THEREOF

Referring now to the drawings, and more particularly to FIGS. 1–6, the apparatus of the invention for generating vapor of a volatile liquid fuel for an internal combustion engine and operating an internal combustion engine therewith generally designated as 20 includes a fuel vapor generating tank 21, a liquid fuel tank 22 and an internal combustion engine 23. The fuel tank 22 is provided with a fill pipe 24 closed off by means of a cap 25. Upon opening valve 26 in conduit 27, a volatile liquid fuel for the internal combustion engine 23 is withdrawn from fuel tank 22 and is passed to pump 28, and the fuel is then pumped through conduit 29 into generating tank 21. The pump 28 is provided with a by-pass conduit 30. Upon opening valve 31, all or a portion of the liquid fuel withdrawn via conduit 27 is allowed to by-pass generating tank 21, and is returned via conduit 30 to fuel tank 22.

Figure 2:
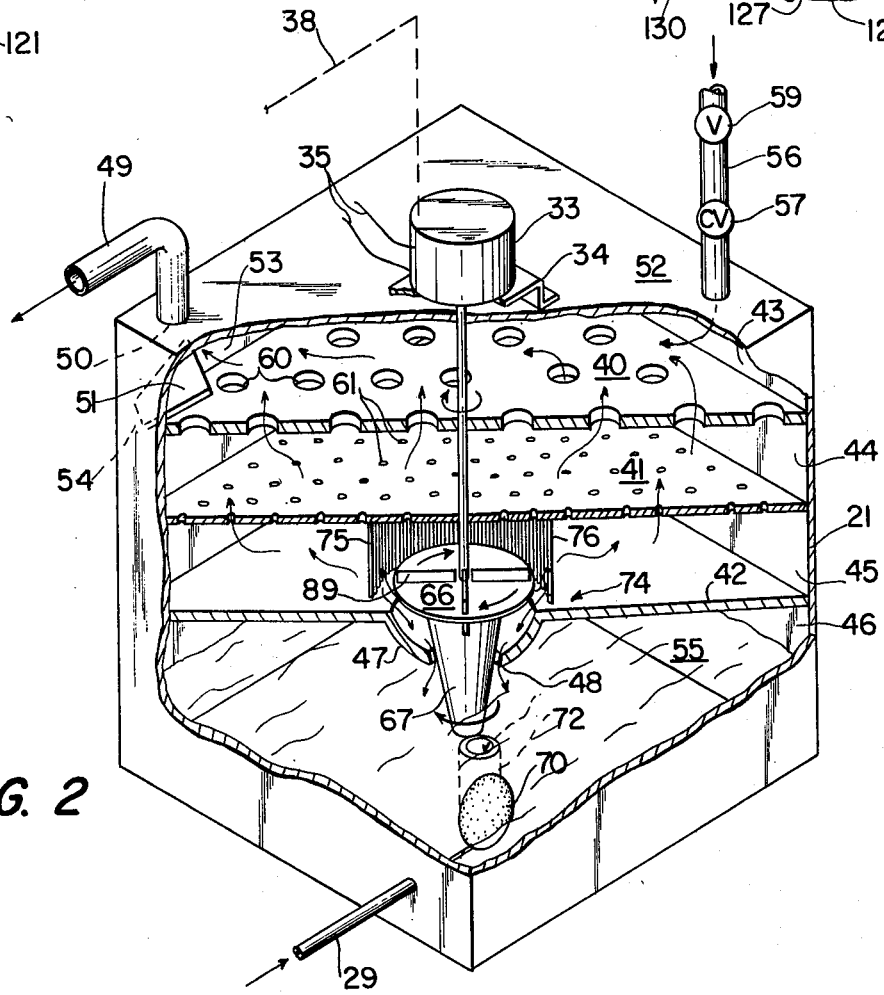
FIG. 2 is a perspective view, with portions thereof being broken away to illustrate the details of construction in the interior, of one presently preferred embodiment of a tank for generating vapor of a volatile liquid fuel for an internal combustion engine.
Figure 3:
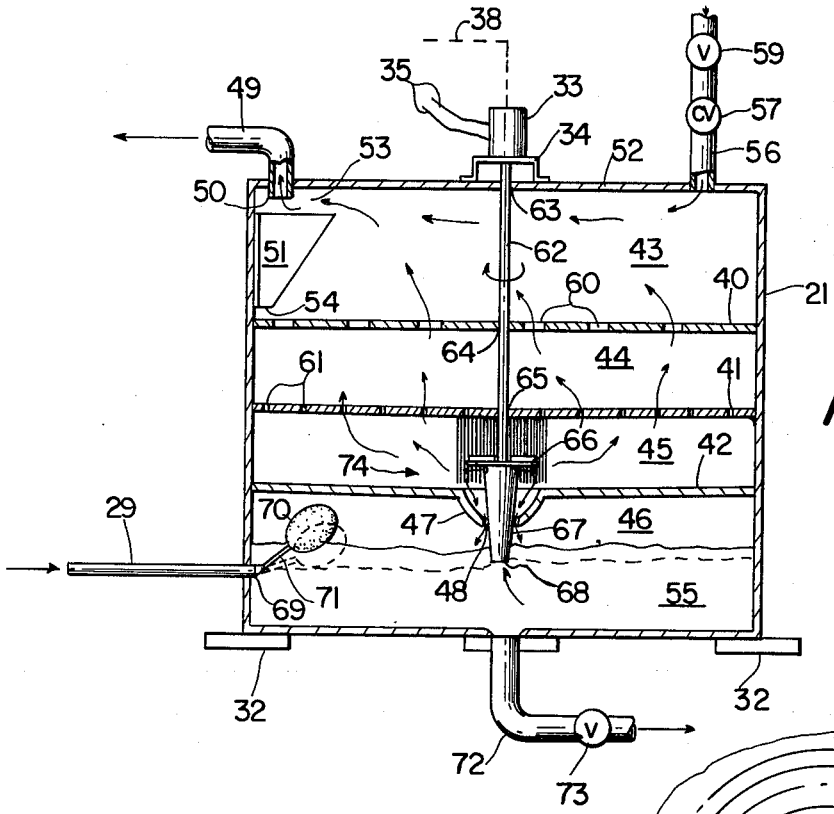
FIG. 3 is a cross-sectional view in elevation of the generating tank of FIG. 2.
Figure 4:
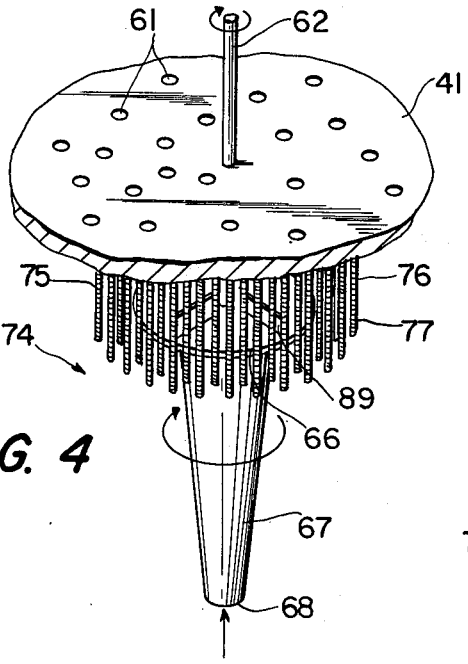
FIG. 4 is an enlarged perspective view, with portions thereof being broken away, of the interior of the generating tank of FIGS. 2 and 3 further illustrating the details of construction of the liquid fuel vaporizing apparatus of the invention.

As is best seen in FIGS. 2 and 3, the generating tank 21 rests upon supports 32 which may be bolted or otherwise suitably attached to a supporting structure such as a frame member of an automotive vehicle. The generating tank 21 is divided by horizontally extending diaphragms 40, 41 and 42 into four interior compartments 43, 44, 45 and 46. The generating tank 21 is also provided with a suction conduit 49 for withdrawing fuel vapor from the interior compartment 43. The suction conduit 49 has a lower end 50 extending slightly into the interior compartment 43 which is protected from the raw liquid fuel 55 by baffle 51. The baffle 51 also aids in preventing any air and/or fuel vapor borne droplets of liquid fuel from reaching the lower end 50 and thereafter passing upward through suction conduit 49. This is of importance in instances when the generating tank 21 is subjected to violent movement which tends to displace the liquid fuel 55 upwardly, such as when it is installed in an automotive vehicle traveling at high speed over rough roads or around sharp curves. As is best seen in FIG. 3, the baffle 51 does not extend upward to the top 52 so as to provide a space 53 thereabove for flow of the fuel vapor into the lower end 50 of conduit 49. The lower end of baffle 51 is provided with an opening 54 to allow drainage of any liquid fuel that collects therebehind downward into the lower compartments 44, 45 and 46 of generating tank 21.

The lower diaphragm 42 has a centrally located annular depressed area which forms a sump 47 for collecting excess liquid fuel. The sump 47 is provided with an annular opening 48 through which the excess liquid fuel is returned from compartment 45 to compartment 46. The diaphragm 42 is continuous with the exception of opening 48, and thus serves as a splash shield which aids in preventing raw liquid fuel 55 from reaching compartments 43, 44 and 45 in the event of violent movement of generating tank 21. The diaphragms 40 and 41 have openings 60 and 61, respectively, formed therein which allow fuel vapor to flow upward through compartments 45, 44 and 43 in the direction of the arrows.

A variable speed electric motor 33 is mounted above the top surface 52 of generating tank 21 by means of bracket 34. The motor 33 may operate on electric current supplied thereto by electrical leads 35. The electric current may be produced by a conventional alternator or generator (not shown) powered by the engine 23, and is preferably of the same voltage as the electrical system of the automotive vehicle in which the engine 23 and tank 21 are installed. As is well known, most automotive vehicles have either 6 volt D.C. or 12 volt D.C. electrical systems and a suitale variable speed electric motor 33 is selected to operate thereon. The operating speed of motor 33 may be varied as desired by means of a prior art speed controller 36 in response to an input signal received from engine 23 via electrical lead 37. The controller 36 produces an output signal in response to the input signal received via lead 37, which is transmitted to motor 33 via electrical lead 38 and is used to control the operating speed thereof.

The motor 33 has a vertically mounted shaft 62 which extends downward through openings 63, 64 and 65 in top 52, diaphragm 40 and diaphragm 41, respectively, into compartment 45. An annular plate 66 is horizontally mounted on the lower end of shaft 62 at approximately 90° thereto. A hollow inverted cone-like member 67 having an opening 68 formed in the pointed lower end thereof is vertically mounted on the undersurface of plate 66. As may be seen from FIGS. 2–6, the plate 66 and inverted cone 67 are mounted on and carried by shaft 62 whereby they are capable of rotating around a phantom extension of the longitudinal axis of rotation of shaft 62. Thus, upon rotation of shaft 62 by motor 33, the plate 66 and the cone 67 spin in a top-like fashion.

Figure 5:
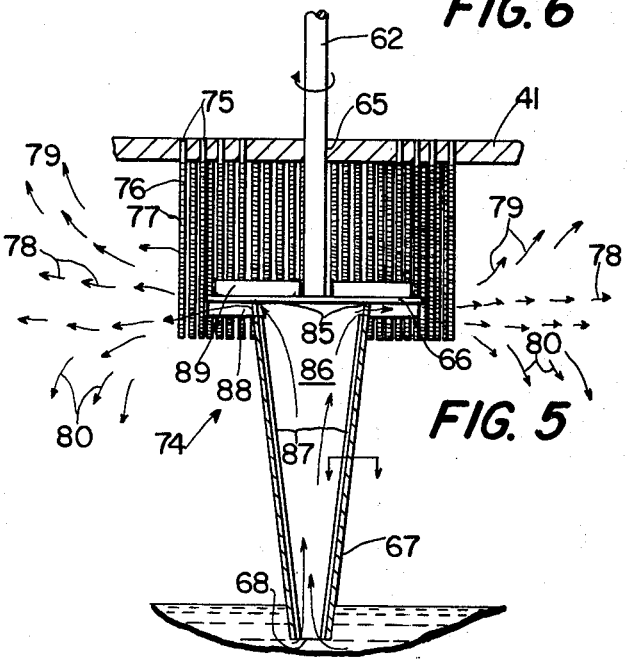
FIG. 5 is an enlarged cross-sectional view in elevation, with portions thereof being broken away, of the interior of the generating tank of FIGS. 2 and 3, further illustrating the details of construction of the apparatus of FIG. 4.
Figure 5A:
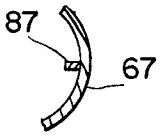

The pointed lower end of cone 67 extends downward through the opening 48 in sump 47 and is immersed in the body of liquid fuel 55 contained in compartment 46. It is important that the lower end of cone 67 be immersed at a desired substantially constant depth within the liquid fuel 55, such as is illustrated in FIGS. 3 and 5. This may be conveniently accomplished by providing a prior art float valve 69 on the end of conduit 29 which is controlled by float 70 mounted on the outer end of float rod 71. As is best seen in FIG. 3, the float valve 69 is in the closed position when the surface of fuel 55 is at the level shown in solid line due to upward pressure being applied thereto by float 70 and rod 71. However, when the surface of fuel 55 falls to the level shown in phantom line, then the float 70 likewise falls to the level shown in phantom line, thereby opening the float valve 69 and allowing liquid fuel to be supplied to compartment 46 via conduit 29 until the surface of fuel 55 returns to the level shown in solid line. The float valve 69 maintains the surface of fuel 55 between the level shown in solid line and the level shown in phantom line, and the lower end of cone 67 is always immersed within the fuel 55 within these limits. When it is desirable to do so, such as for cleaning purposes or when the generating tank 21 will not be used for an extended period of time, the fuel 55 may be drained from compartment 46 via conduit 72 upon opening valve 73.

The interior compartment 45 includes apparatus generally designated as 74 for subdividing and dispersing the raw liquid fuel 55 into finely divided particles or droplets and producing fuel vapor. Upon rotation of shaft 62, the liquid fuel 55 is withdrawn and passes upward through opening 68 in the lower end of cone 67, and then along the internal wall 86 until it reaches openings 85. The liquid fuel flows through openings 85 onto the lower surface of plate 66, and then toward the outer circumference thereof. The lower surface of plate 66 is provided with fins 88, which aid in forming relatively large droplets from the withdrawn liquid fuel 55 as the rotation thereof in the direction of the arrow tends to throw liquid droplets of fuel outward by means of centrifugal force. Also, the fins 88 strike droplets of fuel which have already been formed thereby aiding in forming still smaller droplets of liquid fuel.

The splines 87 extend upward along the internal wall 86 from the opening 68 to the openings 85 and aid in withdrawing the liquid fuel 55 at a controlled rate and continuously supplying a desired amount thereof for discharge through the openings 85. The amount of liquid fuel 55 supplied to the interior compartment 45 is in excess of that normally required to operate the internal combustion engine 23, and the excess is withdrawn via opening 48 and returned to the interior compartment 46.

Figure 6:
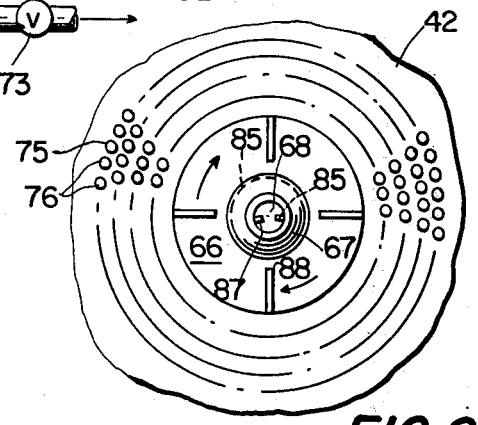
FIG. 6 is a bottom view of the apparatus illustrated in FIG. 4.

The relatively large droplets of liquid fuel produced by the centrifugal action of the undersurface of rotating plate 66 and the lower fins 88 are thrown against the nail-like members 76 to thereby produce, through the resultant impact action, a finely divided mist-like dispersion of the liquid fuel which fills the compartment 45. As is best seen in FIGS. 5 and 6, the nail-like members 76 are supported by diaphragm 41 and extend downward therefrom, and are provided with a large number of sharp edged annular corrugations 77 along their length. A plurality of staggered annular rows 75 of nail-like members 76 extend around the plate 66 and are spaced from the outer circumference thereof. Thus, the relatively large droplets of liquid fuel thrown from plate 66 and/or lower fins 88 will strike at least one, and often several, of the nail-like members 76 as they travel in the general direction of the horizontal arrows 78. The finer and lighter particles of liquid fuel thus produced pass upward in the general direction of arrows 79, and the larger and heavier particles of liquid fuel pass downward in the general direction of arrows 80. The lighter finely dispersed particles of liquid fuel, due in part to the great increase in surface area, rapidly evaporate to form fuel vapor. The larger and heavier particles of liquid fuel fall downward and collect on the upper surface of diaphragm 42 and flow into sump 47, and are then returned to compartment 45 via opening 48 for recycle.

The upper surface of plate 66 is provided with a plurality of fins 88 which likewise aid in throwing relatively large particles of liquid fuel onto the nail-like members 76 for further subdivision by impact. The fins 89 also perform the additional important function of serving as a fan for agitating the fuel vapor phase which exists within the compartment 45. A stream of agitated fuel vapor is passed from upper fins 89 through the plurality of staggered rows 75 of nail-like members 76 in the general direction of the horizontal arrows 78. The resultant stream or screen of fuel vapor flows in a generally horizontal direction and also serves as a classifying means for the heavier and lighter particles of liquid fuel. The finer and lighter particles of liquid fuel, as well as the fuel vapor produced upon evaporation thereof, tends to be forced upward thereby in the general direction of arrows 79, whereas the heavier and larger particles of liquid fuel tend to be forced downward thereby in the general direction of arrows 80. Additionally, the agitated fuel vapor phase within the compartment 45 rapidly reaches an equilibrium with the liquid fuel phase that exists in the form of liquid fuel particles. The above, in combination with the fuel vapor screen classification of the fuel particles, allows fuel vapor and very finely divided particles of liquid fuel to be concentrated on the undersurface of or near diaphragm 41. The openings 61 are sufficiently small to retain large droplets or particles of liquid fuel in compartment 45, and fuel vapor passes through openings 61 into compartment 44. The fuel vapor phase existing within compartment 44 is normally saturated and it does not contain a substantial amount of particulate liquid fuel. The saturated fuel vapor is withdrawn from compartment 44 and is passed through openings 60 into the interior compartment 43. The fuel vapor phase existing within interior compartment 43 is likewise substantially free of liquid fuel particles.

The combination of: (a) the centrifugal force imparted to the liquid fuel flowing through the openings 85 by the outer edge of rotating plate 66, rotating fins 88 and rotating fins 89 to thereby produce relatively large particles of liquid fuel; (b) the impact action of the nail-like members 76 on the existing fuel particles, and also the impact action of the fins 88 and 89 to some extent, to produce still further subdivision of the initial fuel particles; (c) the fuel vapor screen classification of the lighter and heavier fuel particles; and (d) the fan-like action of the lower fins 88 and especially the upper fins 89 to agitate the fuel vapor phase; results in a saturated fuel vapor phase being rapidly produced and maintained in compartment 45. The resultant saturated fuel vapor is available at all times for passing upwards through openings 61 into compartment 44, and then through openings 60 into compartment 43, at a rate dependent upon the demand therefor by internal combustion engine 23.

The generating tank 21 has an air supply conduit 56 provided with a one-way flow control valve 57 biased in the closed position and a normally opened stop valve 59. Atmospheric air is introduced into the interior 43 via conduit 56, and it admixes with the rising fuel vapor as it flows in the direction of the arrows. The resultant admixture of fuel vapor and air is withdrawn via suction conduit 49. The operation and construction of valve 57 may be the same as illustrated in FIG. 13 of the drawings, and thus it is closed when suction is not applied to conduit 49, i.e., when the internal combustion engine 23 is not operating. When the internal combustion engine 23 is operating, suction is applied by suction condiut 49 and the valve 57 is moved to the open position due to the reduced pressure in the interior 43 thereby allowing atmospheric air to be drawn through conduit 56.

The volume of air introduced into the interior 43 via conduit 56 is insufficient to produce an explosive mixture or to provide for optimum combustion of the fuel vapor withdrawn via suction conduit 49. Accordingly, it is necessary to add additional air thereto in a variable amount which is determined by the operating characteristics of internal combustion engine 23. This is done by passing the admixture of fuel vapor and air withdrawn from space 43 via suction conduit 49 to air-fuel vapor ratio adjusting device 58.

Figure 1:
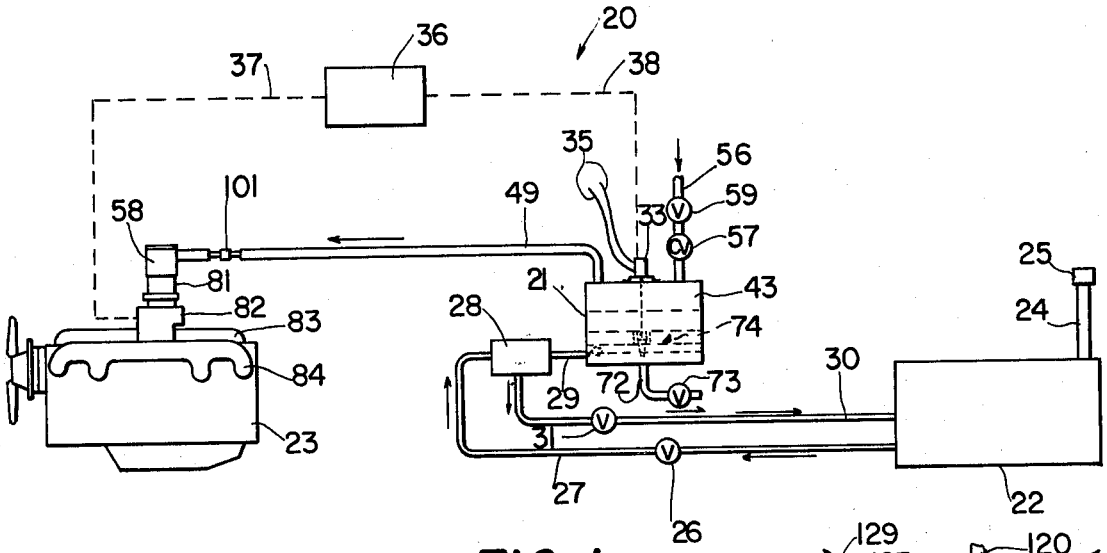
FIG. 1 is a schematic illustration of one presently preferred embodiment of apparatus in accordance with the invention for generating vapor of a volatile liquid fuel for an internal combustion engine and operating an internal combustion engine therewith.
Figure 7:
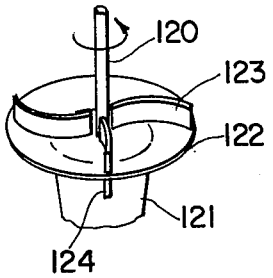
FIG. 7 is a perspective view, with portions thereof being broken away, of a modified form of the apparatus of FIGS. 4, 5 and 6.
Figure 8:
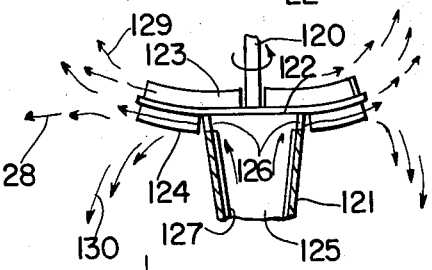
FIG. 8 is a cross-sectional view in elevation of the apparatus of FIG. 7.

Referring now to FIGS. 7 and 8 of the drawings, which illustrate a modification of the apparatus 74 previously discussed, the rotating shaft 120 is attached to a prior art electric motor (not shown) such as electric motor 33 previously discussed. The inverted rotating cone 121 is identical with inverted cone 67 previously discussed, and thus the lower end thereof is open and is immersed in liquid fuel 55 (not shown). The annular rotating plate 122 has been modified to have a generally saucer-like configuration, and the upper portion of cone 121 is attached to the relatively flat centrally located portion thereof. The annular outer edge portion of plate 122 is curved upward somewhat, as is best seen in FIG. 8 of the drawings. As is best seen in FIG. 7, the upper surface of plate 122 has a plurality of upper fins 123 which are curved opposite to the direction of rotation as they extend toward the outer edge of plate 122. The lower fins 124 on the lower surface of plate 122 are likewise curved opposite to the direction of rotation and have a configuration similar to that of upper fins 123 in this respect.

The curved annular outer edge portion of plate 122 allows the liquid fuel flowing from openings 126 to be passed in the direction of the horizontal arrows 128, as is likewise true of the curved lower fins 124. Additionally, the curved upper fins 123 allow the air stream or screen produced thereby to be passed in the direction of the horizontal arrows 128. This results in the finer and lighter fuel particles and fuel vapor being passed upward in the direction of the arrows 129, and the heavier and larger fuel particles being passed downward in the direction of arrows 130. The splines 127 are identical in construction with the splines 87 previously discussed and thus extend along the internal wall 125 upward to the openings 126. It is understood that other than the modifications discussed above for FIGS. 7 and 8, the remaining apparatus 74 is identical in construction and in operation with that illustrated in FIGS. 2 through 6 of the drawings.

The internal combustion engine 123 is of the type conventionally used in powering automotive vehicles such as automobiles, trucks, buses and the like with the exception of being adapted for operating in accordance with the present invention on the fuel vapor produced in generating tank 21. The internal combustion engine 23 has the usual breather 81, but the conventional carburetor which normally is positioned thereon has been removed. The conventional throttle means 82, intake manifold 83, exhaust manifold 84, and the remaining major components have also been retained with the exception of disconnecting the fuel pump 28 from the carburetor and utilizing it as previously described with generating tank 21 for the pumping of liquid fuel.

Figure 10:
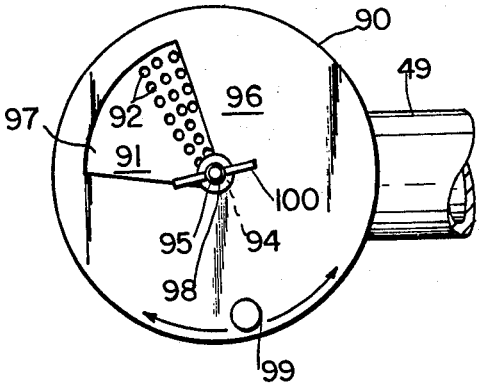
FIG. 10 is a top view of the assembled apparatus of FIG. 9.

Referring now to FIGS. 9 and 10 of the drawings, the fuel vapor-air ratio adjusting device 58 includes a hollow cup-shaped adapter 90 having an open lower end which conforms with the upper surface of breather 81 and is mounted thereon in approximately the same position as the conventional carburetor. The upper end of the adapter 90 is closed off by means of a perforated plate 91 which is formed integrally therewith. The perforated plate 91 is provided with a plurality of air holes 92 which are in communication with the hollow interior of adapter 90. The side wall of adapter 90 is provided with an opening 93 which receives the end of suction conduit 49 and thereby allows the admixture of fuel vapor and air flowing in conduit 49 to be introduced into the hollow interior. The perforated plate 91 is provided with a centrally located opening 94 which receives the upright threaded bolt 95. A circular top plate 96 having a diameter similar to that of perforated plate 91 and an aperture 97 of a configuration designed to expose and/or close off the air holes 92 is provided. The plate 96 has an opening 98 centrally located therein for receiving the threaded bolt 95 which extends therethrough. As is best seen in FIG. 10, the top plate 96 is positioned over the perforated plate 91, and is rotated by means of thumb button 99 in the directions of the arrow until the desired number of air holes 92 are exposed to the ambient atmosphere thereby allowing atmospheric air to be passed into the interior of adapter 90 in a controlled amount. The wingnut 100 is then tightened on the threaded bolt 95 to thereby retain the top plate 96 in the adjusted position.

As is well known, the breather 81 is in communication with the intake manifold 83, which is in communication with the interior of the cylinders of the internal combustion engine during the fuel intake cycle, and thus constitutes a fuel supply means for supplying fuel vapor to the cylinders for combustion in response to reduced pressure within the cylinders. The resultant fuel supply means produces suction on the interior of adapter 90, the suction conduit 49, and the interior 43 of generating tank 21. This causes the admixture of fuel vapor and air flowing in suction conduit 49 to be introduced into adapter 90, and also causes additional atmospheric air to be introduced therein via the exposed air holes 92. Sufficient additional air is introduced into adapter 90 to assure that the most efficient fuel vapor-air admixture is produced for combustion in the cylinders of internal combustion engine 23. As is well understood in this art, this may be accomplished by rotating the top plate 96 until the internal combustion engine 23 operates in the most efficient manner as determined by the power produced and/or by the composition of the exhaust emissions. When the most efficient fuel vapor-air admixture is produced, then the top plate 96 is tightened into position by means of wingnut 100.

Figure 11:
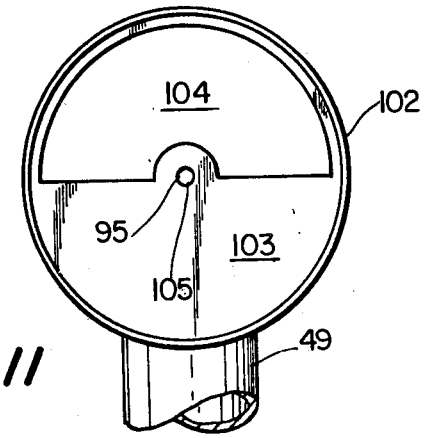
FIG. 11 is a top view, with the perforated air control disc being removed to illustrate the interior, of a modified form of apparatus similar to that illustrated in FIG. 9.

The cup shaped adapter 90 discussed above is especially useful with internal combustion engines which formerly had a four-barrel carburetor. The cup shaped adapter 102 illustrated in FIGS. 11 and 12 is especially useful with internal combustion engines which formerly had a two barrel carburetor. The adapter 102 has a general configuration similar to that of adapter 90 with the exception of the top being closed off by plate 103 which is formed integrally therewith. The plate 103 has a large opening 104 formed therein which extends approximately 180° around the circumference thereof. A smaller opening 105 is provided which is centrally located and receives threaded bolt 95. The perforated plate 106 has a plurality of air holes 107 formed therein and arranged in a configuration to be either in communication with the opening 104 and/or closed off by the remainder of plate 103 when placed thereover. The plate 106 is also provided with a thumb button 108, by means of which plate 106 may be adjusted in the directions of the arrow to thereby expose and/or close off a desired number of the air holes 107. The perforated plate 106 is shown removed from adapter 102 for purposes of clarity. However, it is understood that the opening 109 is for the purpose of receiving threaded bolt 95 upon placing plate 106 over plate 103. Also, following adjustment thereof by means of thumb button 108, the same is tightened into position with a wingnut such as wingnut 100 discussed in connection with FIGS. 9 and 10. It is further understood that the suction conduit 49 introduces the fuel vapor and air mixture flowing therein into the interior of adapter 102 in the manner previously described for adapter 90. Also, the adjustment and operation of adapter 102 is as previously described for adapter 90.

The suction conduit 49 includes a one-way flow valve 101 which serves as a safety check valve for preventing the adverse effects of backfire originating in the vicinity of adapter 90 or adapter 102. The valve housing 110 has an internally arranged annular projection 111 which is in sealing engagement with moveable valve member 112 mounted on pin 113 when in the normal biased position. Upon applying suction to adapter 90 or 102, the valve member 112 is rotated from the normal closed position illustrated in dotted line to the open position illustrated in solid line. The valve member 112 remains in the open position so long as suction is applied to suction conduit 49, i.e., while the internal combustion engine 23 is operating. In the event of backfire, the flow of gases from adapter 90 or 102 toward check valve 101 results in an immediate repositioning of valve member 112 from the position illustrated in solid line to the position illustrated in dashed line thereby tightly closing off the suction conduit 49 and preventing backfire damage. As was discussed hereinbefore, the check valve 57 may also be constructed in accordance with the check valve 101. It is understood that various types of prior art check valves may be used as check valves 57 and 101.

Prior art materials for the construction of fuel tanks for a conventional automotive vehicle such as an automobile, truck or bus, may be used for the construction of the generating tank 21. Examples of suitable materials include tin plated or galvanized steel, copper and brass. Plastics may be used when desired, and especially plastics of the types commonly used in fuel tanks for power mowers, garden tractors and the like.

The fuel to be vaporized in generating tank 21 may be any suitable readily volatilized normally liquid fuel for an internal combustion engine. Examples of suitable fuels include volatile hydrocarbons, alcohols and admixtures thereof. Conventional gasoline is usually preferred, but hydrocarbons, alcohols and admixtures thereof boiling within the gasoline range, i.e., approximately 95° F. to 450° F., may be used. Gasohol, which is an admixture of gasoline and one or more lower alcohols such as methyl, ethyl, propyl and/or isopropyl alcohol, is also useful. As will be understood by those skilled in this art, volatile normally liquid fuels having suitable characteristics for operation of an internal combustion engine provided with a conventional carburetor also may be used in practicing the present invention.

The pump 28 may be a conventional fuel pump of the type that is used in operating a prior art internal combustion engine with a carburetor. Thus, the fuel pump that is used on a given conventional internal combustion engine having a carburetor may be used for the purpose of pumping liquid fuel to the generating vessel 21 after that same internal combustion engine has been modified to operate in accordance with the present invention.

The fuel pump that is normally used may be merely disconnected at the carburetor inlet and then connected to the liquid fuel conduit 29 of the present invention. The fuel pump 28 may be conventionally operated off the camshaft of the modified internal combustion engine 23, or it may be a prior art electrical fuel pump. It is also possible to use other types of prior art pumps suitable for pumping gasoline and other volatile liquid fuels for internal combustion engines.

The operating speed of motor 33 may be varied in response to the operating speed of internal combustion engine 23 by any convenient method. For example, the speed of motor 33 may be controlled by the automobile accelerator or throttle 82, a tachometer measuring the operating speed of the internal combustion engine 23, or by other convenient means. It is understood that, as a general rule, the speed of electric motor 33 need only be sufficiently high to assure that the quantity of liquid fuel 55 withdrawn from compartment 46 and introduced into compartment 45 is greater than that required for operation of the internal combustion engine 23. The resultant excess of liquid fuel 55 is merely returned to the compartment 46 via sump 47 and opening 48. Additionally, usually it is only necessary that sufficient fuel vapor be produced for operating internal combustion engine 23, and amounts substantially in excess of the minimum amount may be produced. Any excess fuel vapor that is produced is merely precipitated from the fuel vapor phase in compartment 45 in the form of liquid fuel that is likewise returned to compartment 45 via sump 47 and opening 48.

The diaphragm 41 has openings 61 which are selected so as to be sufficiently small to prevent the passage of liquid particulate fuel into compartment 44 in an objectionable amount which will, for example, result in the precipitation of liquid fuel in compartment 44, compartment 43 or conduit 49. It is usually preferred that the openings 60 in partition 40 be of a size allowing fuel vapor to be withdrawn readily from compartment 44 by means of suction on conduit 49. Thus, comparatively large openings are usually preferred which allow more responsive and easier transfer of fuel vapor from compartment 44 to compartment 43 in response to rapid changes in demand. It is understood that membranes 40 and 41 may be constucted of any material suitable for the intended purpose, such as fibrous materials and perforated membranes.

Operating an internal combustion engine 23 modified in accordance with the present invention has many advantages over the operation of the same internal combustion engine with a conventional carburetor prior to the modification. The internal combustion engine 23 is far more efficient and fuel consumption is reduced very markedly to thereby assure greatly increased mileage for automotive vehicles powered therewith. The exhaust emissions are also much lower as the fuel vapor burns more cleanly and completely. Exhaust emission pollution is reduced to acceptable levels in many instances without the need for treatment of the exhaust gases in the presence of a catalyst. Vaporization of the liquid fuel also assures that solid and high boiling contaminants contained in the initial liquid fuel are not introduced into the internal combustion engine. Oil changes may be made at longer mileage intervals and less maintenance in general is needed. The internal combustion engine 23 also has a longer overall useful life. In view of the foregoing, the present invention is of great economic importance due to the shortage and rapidly rising cost of fuel for internal combustion engines. Also, the present invention is of great practical importance as the pollution problem caused by the exhaust emissions of internal combustion engines operated in congested metropolitan areas is reduced very markedly.

A conventional internal combustion engine of the type installed in an automotive vehicle may be easily and inexpensively modified to operate in accordance with the invention. For example, a prior art gasoline engine installed in an automotive vehicle may be modified by disconnecting the fuel line at the carburetor, and then removing the carburetor and air filter. The fuel pump is allowed to remain in place and it is used as fuel pump 28, and the fuel line formerly attached to the carburetor is attached to conduit 29. The fuel tank 22 is the conventional fuel tank for the automotive vehicle and need not be changed in any respect as the fuel withdrawal line 27 is already attached to fuel pump 28. It is only necessary to provide the generating tank 21, air-fuel vapor ratio adjusting device 58, and the associated apparatus and controls therefor in the form of a modification kit. Inasmuch as the items in the kit may be adapted to fit a given year and model of automobile, the installation thereof requires only a short period of time. The generating tank 21 is of a size fitting easily within the trunk, or it may be installed under the hood of certain models. Additionally, the design and method of construction of the items making up the modification kit are relatively inexpensive to manufacture and the kit may be sold at a reasonable cost. It is understood that a conventional air filter, which is omitted from FIG. 1 of the drawings for purposes of clarity, may be included in the modification kit to provide means for filtering the atmospheric air added by air-fuel vapor ratio adjusting device 58. Thus, the present invention provides a novel method and improved apparatus for modifying a conventional internal combustion engine including a prior art carburetor whereby the resultant modified internal combustion engine operates more efficiently and with lower exhaust emissions on fuel vapor that may be generated from the normally liquid fuel previously used.

The routine operation of the modified internal combustion engine 23 following installation of the adaptor kit will be discussed briefly to provide a more complete understanding of the invention. For the purpose of this discussion, it will be assumed that the modified internal combustion engine 23 has been operated after installation of the modification kit, but is presently not operating. Accordingly, the check valves 57 and 101 are in the closed positions, and a supply of fuel vapor exists within the interior 43 of generating tank 21 and within fuel vapor suction conduit 49 as a result of the previous operation. This fuel vapor is available for start-up and, upon turning the ignition switch, the internal combustion engine 23 starts up immediately. Thereupon, the fuel pump 28 which remains installed on internal combustion engine 23, pumps liquid fuel from fuel tank 22 into generating tank 21 upon demand to maintain the level of liquid fuel 55 as shown in solid line in FIG. 3.

The electric motor 33 is operated at a speed to withdraw sufficient liquid fuel 55 through opening 66 to provide an excess over that required for operating internal combustion engine 23. The withdrawn liquid fuel 55 passes up through cone 67 and is discharged through openings 86. Thereafter, the withdrawn liquid fuel 66 is subdivided, dispersed, and vaporized as previously discussed. The resultant fuel vapor is then passed through openings 61 into compartment 44, and then through openings 60 into compartment 43. The saturated fuel vapor in compartment 44 has a relatively low temperature and the temperature is approximately that of the liquid fuel in tank 22 or slightly below. The cool vapor has a high volumetric efficiency when used to operate internal combustion engine 23 as compared with fuel vapor produced by a high temperature volatilization process.

The saturated fuel vapor stabilizes as it flows upward toward the top 52. The temperature thereof increases slightly, and the pressure is reduced slightly due to suction on fuel vapor conduit 49. Additionally, it is admixed with atmospheric air introduced via conduit 56 in an amount to reduce the dew point, but in an amount insufficient to form an explosive mixture, and also in an amount insufficient for efficient combustion. Thus, the admixture of fuel vapor and air withdrawn via fuel vapor suction conduit 49 has a temperature far below the dew point of the fuel vapor. There is no tendency for small or microscopic fog like particles of liquid fuel to form therein, or for the surfaces in contact therewith to be wetted with a precipitated liquid fuel phase. This is assured by generating the fuel vapor at a low temperature, applying no pressure thereto as it is passed to device 58, allowing the temperature thereof to remain the same or increase slightly, and lowering the dew point of the fuel vapor by admixing air therewith.

The admixture of fuel vapor and air introduced into air-fuel vapor ratio adjusting device 58 is free of liquid fuel and all surfaces in contact therewith are free of liquid fuel during operation of the internal combustion engine 23. This is of importance as the efficiency of internal combustion engine 23 is increased markedly, and the undesirable exhaust emissions are decreased very markedly. Following admixture of additional air in air-fuel vapor ratio adjusting device 58 in an amount for efficient combustion, the resultant liquid fuel-free admixture is passed to intake manifold 83, and thereafter to the cylinders of internal combustion engine 23 upon demand.

The foregoing detailed description of the invention and the accompanying drawings are for purposes of illustration only, and are not intended as being limiting to the spirit or scope of the appended claims.

I claim:

1. In apparatus for generating vapor of a volatile liquid fuel for an internal combustion engine and operating an internal combustion engine therewith, the said apparatus including vessel means containing the said fuel vapor thus generated in the interior thereof and an internal combustion engine, the internal combustion engine having a plurality of cylinders for combustion of the fuel vapor and air-fuel vapor supply means for supplying a combustible admixture of air and fuel vapor to the cylinders in response to reduced pressure within the cylinders, the said air-fuel vapor supply means including an intake manifold means in communication with the interior of the cylinders, air-fuel vapor conduit means in communication with the interior of the said intake manifold means and throttle means in the said air-fuel vapor conduit means upstream of the said manifold means whereby suction is applied to the said air-fuel vapor conduit means and a combustible admixture of air and fuel vapor is supplied to the cylinders as needed for operating the internal combustion engine at varying speeds controlled by the said throttle means, the improvement which comprises air-fuel vapor conduit means having first and second end portions, the said first end portion being in communication with the interior of the intake manifold means and the said second end portion being in communication with a first portion of the interior of the said vessel means containing the fuel vapor whereby when the internal combustion engine is operating the said air-fuel vapor supply means supplies fuel vapor to the cylinders and suction is applied to the said air-fuel vapor conduit means which causes fuel vapor to be withdrawn from the first portion of the said vessel means by suction and passed through the air-fuel vapor conduit means to the said intake manifold means, the interior of the said vessel means being maintained under a pressure no greater than the ambient atmospheric pressure and the contents thereof being unheated by an extraneous source of heat, means in a second portion of the interior of the said vessel means for vaporizing volatile normally liquid fuel for an internal combustion engine to thereby produce additional fuel vapor in the said vessel means, the said vaporizing means being effective for vaporizing unheated volatile liquid fuel at a pressure not exceeding the ambient atmospheric pressure and with the resulting fuel vapor phase in the said first portion being free of suspended liquid fuel droplets whereby the fuel vapor contained in the said first portion of the said vessel means is unheated by an extraneous source of heat, is under a pressure no greater than the ambient atmospheric pressure and is free of suspended finely divided liquid fuel, the said vaporizing means including means for withdrawing said unheated liquid fuel from a body thereof and introducing an excess of the resultant withdrawn liquid fuel into the said second portion of the vessel means, means including rotary means for producing through the action of centrifugal force a plurality of relatively large particles of liquid fuel from the said withdrawn liquid fuel, and means for further subdividing through an impact action the said relatively large particles of liquid fuel into a plurality of finely divided dispersible liquid fuel particles and dispersing the same in the said second portion of the vessel means to thereby vaporize a portion of the said withdrawn liquid fuel and produce fuel vapor, diaphragm means for dividing the interior of the said vessel means into the said first and second portions, the diaphragm means having a plurality of openings therein of a size to allow passage of the fuel vapor produced in the said second portion into the said first portion of the vessel means, the said openings in the diaphragm being of a size to retain the said relatively large and finely divided particles of liquid fuel in the said second portion of the vessel means, and means for withdrawing the said excess of liquid fuel from the said second portion of the vessel means.

2. The apparatus of claim 1 wherein means is provided for varying the rate at which liquid fuel is introduced into the said second portion of the vessel means.

3. The apparatus of claim 1 wherein means is provided for varying the rate at which the said liquid fuel is vaporized in the said second portion of the vessel means.

4. The apparatus of claim 3 wherein means is provided for varying the rate at which liquid fuel is introduced into the said second portion of the vessel means.

5. The apparatus of claim 1 wherein a baffle means is in the said first portion of the vessel means and is positioned to prevent liquid fuel from being withdrawn by the fuel vapor conduit means when the said vessel means is subjected to violent movement.

6. The apparatus of claim 5 wherein the top of the baffle means is spaced from the top of the said vessel means sufficiently to provide a passageway for the fuel vapor to flow to the said fuel vapor conduit means.

7. The apparatus of claim 5 wherein the lower portion of the baffle means is provided with an opening for liquid fuel to drain therefrom.

8. The apparatus of claim 1 wherein agitation means is provided for agitating the fuel vapor contained in the said second portion of the vessel means.

9. The apparatus of claim 8 wherein the agitation means includes a fan means for agitating the fuel vapor.

10. The apparatus of claim 9 wherein the fan means produces a stream of vapor, and the fan means is positioned with respect to the said vaporizing means whereby the vapor stream serves to classify the said particles of liquid fuel into a finely divided relatively light fraction which is directed towards the said diaphragm means and into a relatively large and heavy particle fraction which is directed away from the said diaphragm means.

11. The apparatus of claim 1 wherein means is provided for admixing air with the liquid fuel free fuel vapor in the said first portion of the vessel means to thereby produce an admixture of air and fuel vapor which is withdrawn via the said fuel vapor conduit means, the said means for admixing air with the fuel vapor being effective to produce an admixture of air and fuel vapor which contains sufficient air to reduce the dew point of the fuel vapor but insufficient air to produce an explosive mixture and less than the amount of air required for efficient combustion of the fuel vapor in the internal combustion engine.

12. The apparatus of claim 11 wherein the said fuel vapor conduit means includes means for adjusting the ratio of air to fuel vapor in the admixture thereof withdrawn from the said vessel means prior to its reaching the intake manifold means to thereby add additional air thereto and produce an admixture containing sufficient air for efficient combustion of the fuel vapor in the internal combustion engine.

13. The apparatus of claim 11 wherein the said fuel vapor conduit means also includes means located between the said second end portion thereof and the said means for adjusting the ratio of air to fuel for protecting the said vessel means against backfire of the internal combustion engine.

14. The apparatus of claim 11 wherein the said fuel vapor conduit means and the said vessel means include means for retaining the fuel vapor therein when the internal combustion engine is not operating to thereby provide fuel vapor for priming the internal combustion engine during start-up.

15. The apparatus of claim 14 wherein the said fuel vapor conduit means also includes means located between the said second end portion thereof and the said means for adjusting the ratio of air to fuel for protecting the said vessel means against backfire of the internal combustion engine.

16. The apparatus of claim 11 wherein the said means for admixing air with fuel vapor in the said vessel means includes unheated ambient air supply conduit means in communication with the said first portion of the interior of the said vessel means for supplying unheated ambient air thereto, check valve means in the air supply conduit means, the said air supply conduit means being located whereby air is introduced into the said vessel means at a point remote from the point of withdrawal of fuel vapor from the said vessel means by the said fuel vapor conduit means, the said first portion of the vessel means being otherwise closed off to the ambient atmosphere whereby when fuel vapor is withdrawn from the said vessel means by suction on the said fuel vapor conduit means the internal pressure within the said vessel means is reduced below the ambient atmospheric pressure when the said check valve means is in the closed position, the said check valve means being normally in the closed position when the internal combustion engine is not operating and being rendered operative to allow the passage of air by suction into the said vessel when the internal combustion engine is operated and the withdrawal of fuel vapor by suction on the fuel vapor conduit means reduces the internal pressure within the said vessel means below the ambient atmospheric pressure.

17. The apparatus of claim 16 wherein the said fuel vapor conduit means also includes means located between the said second end portion thereof and the said means for adjusting the ratio of air to fuel for protecting the said vessel means against backfire of the internal combustion engine.

18. The apparatus of claim 17 wherein the said check valve means and the said means for protecting the vessel means against backfire also include means for retaining the fuel vapor in the said fuel vapor conduit means and the said vessel means when the internal combustion engine is not operating to thereby provide fuel vapor for priming the internal combustion engine during start-up.

19. The apparatus of claim 18 wherein agitation means is provided for agitating the fuel vapor contained in the said second portion of the vessel means.

20. The apparatus of claim 19 wherein the agitation means includes a fan means for agitating the fuel vapor.

21. The apparatus of claim 20 wherein the fan means produces a stream of vapor, and the fan means is positioned with respect to the said vaporizing means whereby the vapor stream serves to classify the said particles of liquid fuel into a finely divided relatively light fraction which is directed towards the said diaphragm means and into a relatively large and heavy particle fraction which is directed away from the said diaphragm means.

22. The apparatus of claim 1 wherein agitation means is provided for agitating the fuel vapor contained in the said second portion of the vessel means, and means is provided for admixing air with fuel vapor in the said first portion of the vessel means to thereby produce an admixture of air and fuel vapor which is withdrawn via the said fuel vapor conduit means, the said means for admixing air with the fuel vapor being effective to produce a said withdrawn admixture of air and fuel vapor which contains sufficient air to reduce the dew point of the fuel vapor but insufficient air to produce an explosive mixture and less than the amount of air required for efficient combustion of the fuel vapor in the internal combustion engine.

23. The apparatus of claim 22 wherein the agitation means includes a fan means for agitating the fuel vapor.

24. The apparatus of claim 23 wherein the fan means produces a stream of vapor, and the fan means is positioned with respect to the said vaporizing means whereby the vapor stream serves to classify the said particles of liquid fuel into a finely divided relatively light fraction which is directed towards the said diaphragm means and into a relatively large and heavy particle fraction which is directed away from the said diaphragm means.

25. The apparatus of claim 22 wherein the said fuel vapor conduit means includes means for adjusting the ratio of air to fuel vapor in the admixture thereof withdrawn from the said vessel means prior to its reaching the intake manifold means to thereby add additional air thereto and produce an admixture containing sufficient air for efficient combustion of the fuel vapor in the internal combustion engine.

26. The apparatus of claim 25 wherein agitation means is provided for agitating the fuel vapor contained in the said second portion of the vessel means.

27. The apparatus of claim 26 wherein the fan means produces a stream of vapor, and the fan means is positioned with respect to the said vaporizing means whereby the vapor stream serves to classify the said particles of liquid fuel into a finely divided relatively light fraction which is directed towards the said diaphragm means and into a relatively large and heavy particle fraction which is directed away from the said diaphragm means.

28. In a method of generating vapor of a volatile liquid fuel for an internal combustion engine and operating an internal combustion engine therewith, the said method including providing vessel means containing the said fuel vapor thus generated in the interior thereof and an internal combustion engine for combustion of the fuel vapor, the internal combustion engine that is provided having a plurality of cylinders for combustion of the fuel vapor and air-fuel vapor supply means for supplying a combustible admixture of air and fuel vapor to the cylinders in response to reduced pressure within the cylinders, the said air-fuel vapor supply means that is provided including an intake manifold means in communication with the interior of the cylinders, air-fuel vapor conduit means in communication with the interior of the said intake manifold means and throttle means in the said air-fuel vapor conduit means upstream of the said manifold means whereby suction is applied to the said air-fuel vapor conduit means and a combustible admixture of air and fuel vapor is supplied to the cylinders as needed for operating the internal combustion engine at varying speeds controlled by the said throttle means, the improvement which comprises providing an air-fuel vapor conduit means having first and second end portions, the said first end portion being in communication with the interior of the said intake manifold means and the said second end portion being in communication with the interior of the said vessel means containing the fuel vapor whereby when the internal combustion engine is operating the said air-fuel vapor supply means supplies fuel vapor to the cylinders and suction is applied to the air-fuel vapor conduit means which causes fuel vapor to be withdrawn from the said vessel means by suction and passed through the air-fuel vapor conduit means to the intake manifold, maintaining the interior of the said vessel means under a pressure no greater than the ambient atmospheric pressure and the contents thereof unheated by an extraneous source of heat, vaporizing volatile normally liquid fuel for an internal combustion engine in a second portion of the said vessel means to thereby produce additional fuel vapor in the said vessel means, the volatile liquid fuel being vaporized at a pressure not exceeding the ambient atmospheric pressure and with the resulting fuel vapor phase in the said first portion being free of suspended liquid fuel droplets whereby the fuel vapor contained in the said first portion of the said vessel means is unheated by an extraneous source of heat, is under a pressure no greater than the ambient atmospheric pressure and is free at all times of suspended finely divided liquid fuel, the liquid fuel vapor being produced by withdrawing said unheated liquid fuel from a body thereof and introducing an excess of the resultant withdrawn liquid fuel into the said second portion of the vessel means, producing through the action of centrifugal force a plurality of relatively large particles of liquid fuel from the said withdrawn liquid fuel, further subdividing through an impact action the said relatively large particles of liquid fuel into a plurality of finely divided dispersible liquid fuel particles and dispersing the same in the said second portion of the vessel means to thereby vaporize a portion of the said withdrawn liquid fuel and produce fuel vapor, dividing the interior of the said vessel means into the said first and second portions with a diaphragm having a plurality of openings therein of a size to allow passage of the fuel vapor produced in the said second portion into the said first portion of the vessel means while retaining the said relatively large and finely divided particles of liquid fuel in the second portion of the vessel means, and withdrawing the excess of liquid fuel from the second portion of the vessel means.

29. The method of claim 28 wherein the fuel vapor contained in the said second portion of the vessel means is agitated.

30. The method of claim 29 wherein the fuel vapor is agitated with a fan.

31. The method of claim 30 wherein the fan produces a stream of vapor, and the fan is positioned whereby the vapor stream serves to classify the said particles of liquid fuel into a finely divided relatively light fraction which is directed towards the said diaphragm and into a relatively large and heavy particle fraction which is directed away from the said diaphragm.

32. The method of claim 28 wherein air is admixed with the liquid fuel free fuel vapor in the said vessel means to thereby produce an admixture consisting essentially of air and fuel vapor, the admixture of air and fuel vapor is withdrawn from the said vessel means via the said fuel vapor conduit means, the air is admixed with the fuel vapor in an amount to reduce the dew point of the fuel vapor in the withdrawn admixture but in an amount insufficient to produce an explosive mixture and less than the amount of air required for efficient combustion of the fuel vapor in the internal combustion engine, and the ratio of air to fuel vapor is adjusted in the admixture thereof withdrawn from the said vessel means prior to its reaching the intake manifold means to thereby add additional air thereto and produce an admixture containing sufficient air for efficient combustion of the fuel vapor in the internal combustion engine.

33. The method of claim 32 wherein the vessel means is protected against backfire of the internal combustion engine after the ratio of air to fuel vapor is adjusted to produce an admixture containing sufficient air for efficient combustion of the fuel vapor in the internal combustion engine.

34. The method of claim 32 wherein fuel vapor is retained in the said fuel vapor conduit means and the said vessel means when the internal combustion engine is not operating to thereby provide fuel vapor for priming the internal combustion engine during start-up.

35. The method of claim 32 wherein unheated ambient air is provided, the vessel means being protected against backfire of the internal combustion engine after the ratio of air to fuel vapor is adjusted to produce an admixture containing sufficient air for efficient combustion of the fuel vapor in the internal combustion engine.

* * * * *